US009803306B2

(12) United States Patent
Yoo et al.

(10) Patent No.: US 9,803,306 B2
(45) Date of Patent: Oct. 31, 2017

(54) CLOTHES TREATMENT APPARATUS AND A METHOD FOR CONTROLLING A CLOTHES TREATMENT APPARATUS

(71) Applicant: LG ELECTRONICS INC., Seoul (KR)

(72) Inventors: Heakyung Yoo, Seoul (KR); Cheolsoo Ko, Seoul (KR); Youngsuk Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 553 days.

(21) Appl. No.: 13/650,265

(22) Filed: Oct. 12, 2012

(65) Prior Publication Data

US 2013/0091727 A1 Apr. 18, 2013

(30) Foreign Application Priority Data

Oct. 13, 2011 (KR) ..... 10-2011-0104390
Oct. 21, 2011 (KR) ..... 10-2011-0108096

(51) Int. Cl.
*D06F 58/28* (2006.01)
*D06F 25/00* (2006.01)
*D06F 35/00* (2006.01)

(52) U.S. Cl.
CPC ..... *D06F 25/00* (2013.01); *D06F 35/007* (2013.01); *D06F 58/28* (2013.01); *D06F 2058/289* (2013.01); *D06F 2058/2854* (2013.01); *D06F 2058/2864* (2013.01)

(58) Field of Classification Search
CPC .... D06F 35/007; D06F 58/28; D06F 58/2877; D06F 58/289; D06F 58/2893; D06F 2058/2854; D06F 2058/2864; D06F 2058/2877; D06F 2058/289; D06F 2058/2893; D06F 25/00; H02P 29/0011
See application file for complete search history.

(56) References Cited

U.S. PATENT DOCUMENTS

2001/0015082 A1 8/2001 Minayoshi et al.

FOREIGN PATENT DOCUMENTS

| | | |
|---|---|---|
| CN | 1590627 | 3/2005 |
| CN | 1609327 | 4/2005 |
| CN | 1657683 | 8/2005 |
| DE | 2 233 698 | 1/1974 |
| DE | 198 58 385 | 6/2000 |
| DE | 10 2009 001 323 | 9/2010 |
| EP | 0 104 502 | 4/1984 |
| EP | 1 526 210 | 4/2005 |
| EP | 2 085 507 | 8/2009 |
| EP | 2 345 757 | 7/2011 |

(Continued)

OTHER PUBLICATIONS

Chinese Office Action dated Jun. 27, 2014. (translation).
European Search Report dated Jan. 28, 2013.

*Primary Examiner* — Jessica Yuen
(74) *Attorney, Agent, or Firm* — Ked & Associates LLP

(57) ABSTRACT

A clothes treatment apparatus and a method for controlling a clothes treatment apparatus are provided. The method may include feeding heated hot air to clothes or other items received in a drum, and dehydrating the clothes or other items by performing a first rotation cycle for rotating the drum at a first RPM for a predetermined period of time. The first RPM may be a RPM that allows a centrifugal force applied to the clothes or other items during rotation of the drum to exceed gravity.

14 Claims, 8 Drawing Sheets

(56) References Cited

FOREIGN PATENT DOCUMENTS

| | | |
|---|---|---|
| JP | 2003-111994 | 4/2003 |
| KR | 1994-0003825 | 5/1994 |
| KR | 10-2005-0038191 | 4/2005 |
| KR | 10-2008-0012432 | 2/2008 |
| KR | 2001-0062761 | 7/2011 |

CLOTHES TREATMENT APPARATUS AND A METHOD FOR CONTROLLING A CLOTHES TREATMENT APPARATUS

CROSS-REFERENCE TO RELATED APPLICATION(S)

This application claims priority to Korean Patent Application No. P2011-0104390, filed in Korea on Oct. 13, 2011, and No. P2011-0108096, filed in Korea on Oct. 21, 2011, which are hereby incorporated by reference.

BACKGROUND

1. Field

A clothes treatment apparatus and a method for controlling a clothes treatment apparatus are disclosed herein.

2. Background

Clothes treatment apparatuses are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Clothes treatment apparatuses having a drying function may include a dedicated drying apparatus having only a drying function, and a combined drying and washing apparatus having clothes drying and washing functions. Based on a structure and shape thereof, there are a drum type clothes treatment apparatus that dries clothes by tumbling the clothes using a rotatable drum, and a so-called cabinet type clothes treatment apparatus that dries clothes on hangers.

In general, a conventional combined drying and washing apparatus may include a tub in which wash water is received. A drum, in which clothes or other items may be placed, may be rotatably installed in the tub. The drum may be connected to a rotating shaft, and a motor may be used to rotate the rotating shaft. The rotating shaft may be rotatably supported by a bearing housing, which in turn may be installed at a rear wall of the tub. The tub may be connected to a suspension that absorbs vibration of the drum and the tub.

For a drying function, a heater duct and a condensing duct may be included. The heater duct may be located above the tub and may be internally provided with a heater and a fan.

One end of the condensing duct may be connected to the tub and the other end of the condensing duct may be connected to the heater duct.

The above described clothes treatment apparatus generally performs an operation of removing moisture from wet clothes or other items. However, there is a need for more efficient removal of moisture contained in wet clothes.

Figure 1:
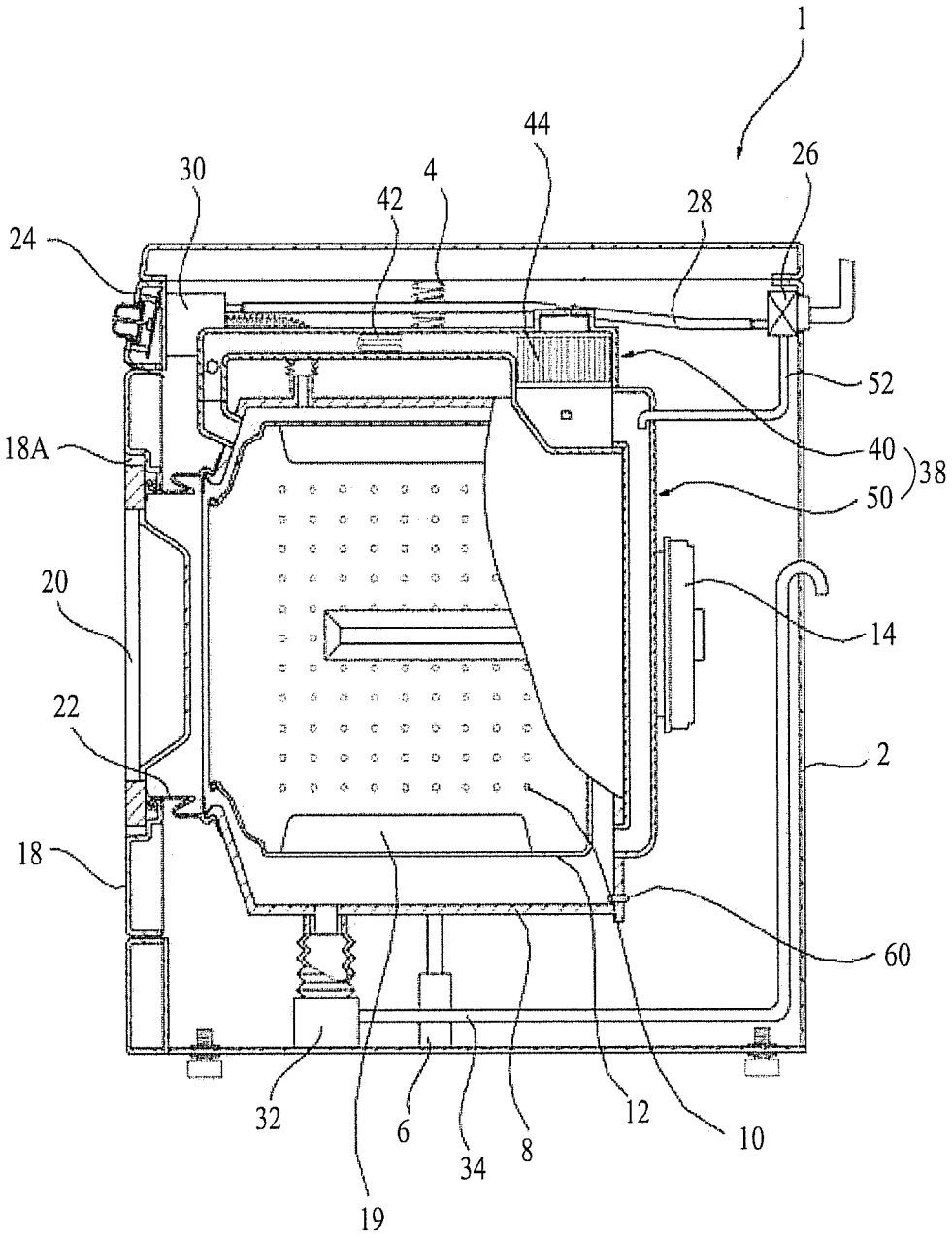
FIG. 1 is a schematic side sectional view of a clothes treatment apparatus according to an embodiment.

FIG. 1 is a schematic side sectional view of a clothes treatment apparatus according to an embodiment. Referring to FIG. 1, the clothes treatment apparatus 1 may include a cabinet 2 that defines an external appearance of the clothes treatment apparatus 1, a tub 8 disposed in the cabinet 2, in which wash water may be received, a drum 12 rotatably installed in the tub 8, and a drive motor 14 that drives the drum 12.

The clothes treatment apparatus 1 may include the cabinet 2; the tub 8, which is positioned in the cabinet 2 in a shock absorbable manner using one or more elastic member(s) 4 and one or more damper(s) 6; the drum 12, which may include a plurality of through-holes 10; the drive motor 14, which may be installed at or to a rear of the tub 8 to enable rotational driving of the drum 12; and a plurality of lifters 19 arranged on an inner wall surface of the drum 12 to allow clothes or other items to be lifted to a predetermined height, and then fall by gravity.

A cabinet cover 18 provided with a clothes entrance/exit opening 18A may be mounted at a front surface of the cabinet 2, and in turn, a door 20 may be pivotally coupled to the cabinet cover 18 to open or close the clothes entrance/exit opening 18A. A gasket 22 may be located between the clothes entrance/exit opening 18A and the tub 8, and may serve not only to alleviate shock caused by rotation of the drum 12, but also as packing to prevent overflow of wash water.

A control panel 24 may be provided above the cabinet cover 18. The control panel 24 may include a display, on which an operating state of the clothes treatment apparatus 1 may be displayed, and an input that allows a user to control operation of the clothes treatment apparatus 1.

A water supply valve 26, a water supply hose 28, and a detergent supply device 30 may be arranged above the tub 8 to communicate with one another to feed wash water and detergent into the tub 8. A drain pump 32 and a drain hose 34 may be arranged below the tub 8 to communicate with each other for outwardly discharging wash water received in the tub 8.

The clothes treatment apparatus 1 may further include a drying device 38 to dry laundry (i.e., clothes or other items) put in the drum 12, using dry hot air. The drying device 38 may be mounted to an exterior of the tub 8 to communicate with the tub 8.

The drying device 38 may include a drying duct 40, through which dry hot air may be discharged into the tub 8, and a condensing duct 50 connected to the drying duct 40 and the tub 8. The condensing duct 50 may serve to condense air circulating from the tub 8 to the drying duct 40 to remove moisture from the circulating air.

The drying duct 40 may be positioned on top of the tub 8 and may extend in a front-to-rear direction. A front end of the drying duct 40 may be connected to a front upper region of the tub 8 to communicate with the interior of the tub 8. A drying heater 42 and a blower fan 44 may be mounted in the drying duct 40.

The drying heater 42 may function to heat low-temperature and low-humidity air received from the condensing duct 50 into high-temperature and low-humidity air. The blower fan 44 may function to suction air condensed in the condensing duct 50 and blow air heated by the drying heater 42 into the tub 8.

The condensing duct 50 may be attached to a rear surface of the tub 8 and may extend vertically. An upper end of the condensing duct 50 may be in communication with a rear end of the drying duct 40 and a lower end of the condensing duct 50 may be communication with a rear lower region of the tub 8. A cooling water supply device 52 may be mounted in the condensing duct 50 to condense wet air received from the tub 8.

Figure 2:
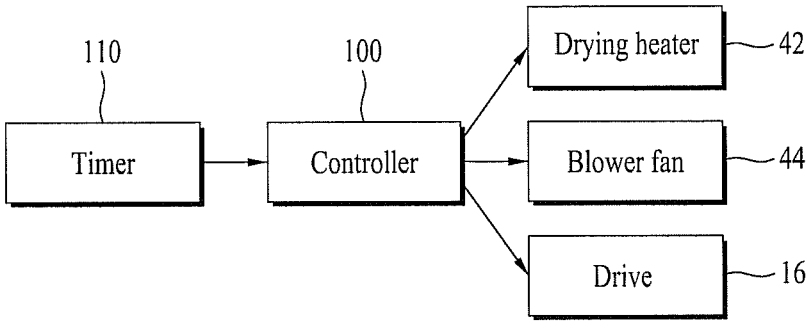
FIG. 2 is a block diagram of the clothes treatment apparatus of FIG. 1.

A command input via the control panel 24 may be input to a controller (100, see FIG. 2). The controller 100 may control driving of the drying heater 42 and the blower fan 44 upon receiving information related to an internal state of the clothes treatment apparatus 1, for example, an interior temperature of the tub 8 and an implementation time of a drying cycle, to enable implementation of an appropriate drying cycle. A detailed control method of the controller will be described later in detail.

A temperature sensor 60 may be provided to inform of the internal state of the tub 8. Although the temperature sensor 60 is shown in FIG. 1 as being located at a bottom of the tub 8, embodiments are not limited thereto. Rather, the position of the temperature sensor 60 may be changeable so long as it allows the temperature sensor 60 to measure the interior temperature of the tub 8.

Normally, high-temperature fluid flows upward. Thus, a higher temperature may be sensed as the position of the temperature sensor 60 is displaced upward. If the temperature sensor 60 is located at an approximately middle height of the tub 8, the temperature sensor 60 may sense an average interior temperature of the tub 8. If the temperature sensor 60 is located at a top of the tub 8, the temperature sensor 60 may sense a highest temperature of the tub 8.

Although the drying device 38 is shown in FIG. 1 as having the drying heater 42 as a component to heat air, the drying device 38 may include a heat pump. More specifically, the drying device 38 may include a heat pump module including an evaporator, compressor, condenser, and expansion valve through which refrigerant may circulate. In this case, air discharged from the drum 12 may be heated and deprived of moisture by the heat pump module. The air deprived of moisture may be redirected back into the drum 12 in a circulation fashion, or may be discharged outward from the clothes treatment apparatus 1 in an exhaustion fashion, via operation of the blower fan 44. A specified configuration of the heat pump is known technology, and thus, a detailed description thereof has been omitted herein.

FIG. 2 is a block diagram of the clothes treatment apparatus of FIG. 1. With this embodiment, a timer 110 may be provided that serves to measure a time taken to perform each operation, or to measure use time of each component. Data related to the time measured by the timer 110 may be transmitted to the controller 100 to assist the controller 100 in controlling a variety of components used in the clothes treatment apparatus 1.

The controller 100 may determine whether to perform each cycle, that is, whether to perform, for example, water supply, washing, rinsing, drainage, dehydration, and drying operations of each cycle, and an implementation time and repetition number of each operation based on a wash course selected by a user, and may control implementation of the aforementioned operations.

With this embodiment, the drying heater 42, which is capable of feeding hot air, may be provided, and the controller 100 may allow hot air to be fed to clothes or other items received in the drum 12 by controlling whether to drive the drying heater 42.

The blower fan 44, which is capable of transferring hot air generated by the drying heater 42 into the drum 12, may also be provided. The blower fan 44 and the drying heater 42 may be driven independently of each other. When the blower fan 44 and the drying heater 42 are driven simultaneously, hot air may be fed to clothes or other items received in the drum 12. On the other hand, when the drying heater 42 is not driven and the blower fan 44 is driven, cold air may be fed to clothes or other items received in the drum 12. The blower fan 44 may also allow the interior air of the drum 12 to circulate through the cabinet 2.

The controller 100 may control a drive 16 including the drive motor 14. When the controller 100 actuates the drive 16, the drum 12 may be continuously or intermittently rotated in a forward or reverse direction. The controller 100 may control an operating time or operating interval of the drive 16 using the timer 110.

Figure 3:
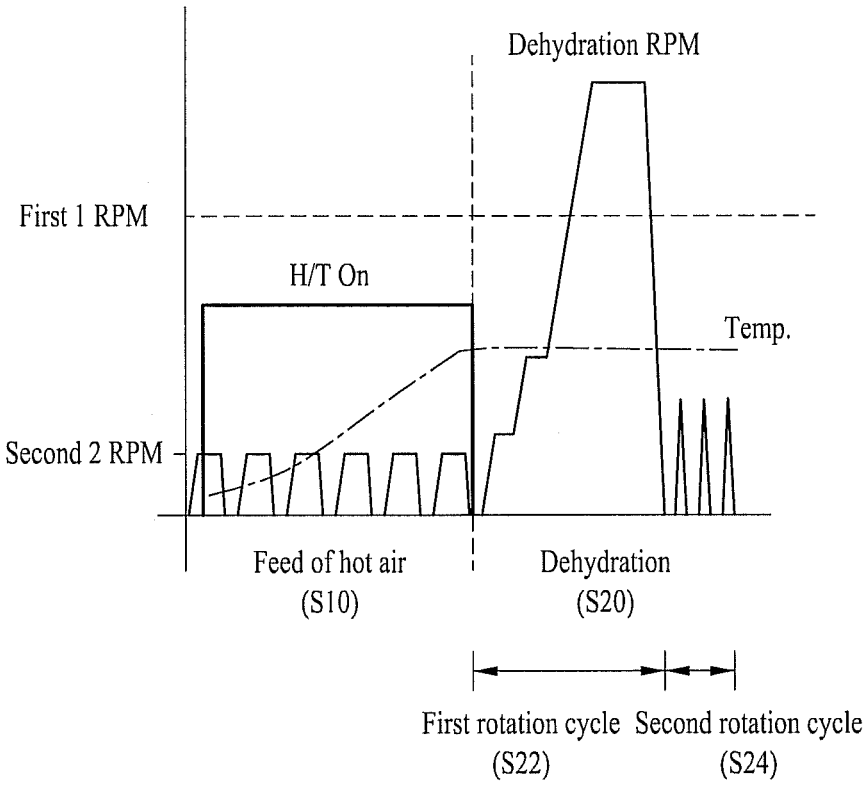
FIG. 3 is a process flow diagram of a method for controlling a clothes treatment apparatus according to an embodiment.

FIG. 3 is a process flow diagram of a method for controlling a clothes treatment apparatus according to an embodiment. It is noted that the methods according to embodiments may be implemented in a clothes treatment apparatus, such as that discussed above with respect to FIGS. 1-2; however, embodiments are not so limited.

As shown in FIG. 3, with this embodiment, the method may include a hot air feed operation for feeding heated air to clothes or other items received in a drum, such as drum 12 of FIG. 1, in step S10, and a dehydration operation for rotating the drum at a first RPM for a predetermined period of time to dehydrate the clothes or other items. In this case, the first RPM may be within a RPM range in which a centrifugal force applied to clothes via rotation of the drum is greater than gravity. A detailed description of the first RPM will be described hereinafter.

The hot air feed operation, step S10, and the dehydration operation, step S20, may correspond to a drying cycle for drying clothes or other items, among a plurality of clothes treatment processes (washing cycle→rinsing cycle→dehydration cycle→drying cycle) of a clothes treatment apparatus. Assuming that the hot air feed operation, step S10, and the dehydration operation, step S20, correspond to the drying cycle, the dehydration cycle may end immediately before the hot air feed operation, step S10, or the hot air feed operation, step S10, and the dehydration operation, step S20, may be performed after a predetermined period of time has passed from completion of the drying cycle, which follows the dehydration cycle.

On the other hand, the hot air feed operation, step S10, and the dehydration operation, step S20, may correspond to the dehydration cycle among a plurality of clothes treatment processes (washing cycle→rinsing cycle→dehydration cycle→drying cycle) of a clothes treatment apparatus. Assuming that the hot air feed operation, step S10, and the dehydration operation, step S20, correspond to the dehydration cycle, the drying cycle for drying clothes or other items may not be performed until the hot air feed operation, step S10, and the dehydration operation, step S20, end. During the drying cycle for drying clothes or other items, hot air may additionally be fed to the clothes or other items.

During the hot air feed operation, step S10, a drying heater, such as drying heater 42 of FIG. 1, may be driven, enabling hot air to be fed into the drum. Since an interior of the drum is heated during the hot air feed operation, step S10, the interior temperature of the tub, such as tub 8 of FIG. 1, as well as the interior temperature of the drum may be raised. More specifically, air heated by the drying heater, and in turn, the heated air may be fed into the drum by a blower fan, such as blower fan 44 of FIG. 1. Alternatively, if the drying device includes a heat pump, air may be heated by the heat pump, and in turn, the heated air may be fed into the drum by the blower fan.

In the course of performing the hot air feed operation, step S10, the drying heater may be continuously driven. Once hot air has been fed to the clothes or other items, moisture contained in the clothes or other items may be reduced in surface tension, and thus, may be easily separated from the clothes or other items.

During the hot air feed operation, step S10, it may be desirable to rotate the drum. That is, the drum may be rotated for a predetermined period of time during the hot air feed operation, step S10. More specifically, the drum may be rotated at a third RPM. In this case, the drum may perform intermittent rotation, such that rotation and stoppage of the drum may be repeatedly performed. That is, during the hot air feed operation, step S10, the drum may be repeatedly rotated and stopped until it reaches the third RPM. In this case, a procedure of again rotating the drum until it reaches the third RPM after a predetermined period of time has passed from stoppage of the drum may be repeatedly performed. The third RPM may be equal to or less than a second RPM of a second rotation cycle, step S24, which will be described hereinafter.

During the dehydration operation, step S20, driving of the drying heater may stop. Thus, no increase may occur in the interior temperature of the drum. On the other hand, the blower fan may be driven during the dehydration operation, step S20, which may allow unheated air to be fed into the drum during the dehydration operation, step S20.

The dehydration operation, step S20, may include a first rotation cycle S22 for rotating the drum at the first RPM for a predetermined period of time, step S22. The dehydration operation, step S20, may further include a second rotation cycle for rotating the drum until the drum reaches a second RPM, step S24. In this case, the second rotation cycle, step S24, may be performed after the first rotation cycle, step S22, ends.

The first rotation cycle, step S22, may involve removing moisture contained in clothes or other items. More particularly, this is a cycle for dehydrating clothes or other items received in the drum. Thus, the first RPM of the first rotation cycle, step S22, may be greater than a minimum RPM required to ensure removal of moisture contained in clothes or other items. Typically, to ensure removal of moisture contained in clothes or other items, a centrifugal force applied to the clothes or other items via rotation of the drum may be greater than gravity. That is, the first RPM may correspond to a rotating speed of the drum to ensure that clothes or other items are continuously adhered to an inner wall surface of the drum under the influence of centrifugal force during rotation of the drum. In addition, the first RPM may be greater than a rotating speed of the drum to ensure that moisture contained in clothes or other items may be separated from the clothes or other items under the influence of centrifugal force. As such, moisture contained in the clothes or other items may be sufficiently removed during the first rotation cycle, step S22.

In this case, the first RPM may be approximately 100 RPM or more, for example, approximately 400 RPM or more. Further, the first RPM may be approximately 800 RPM or more. If the first RPM is approximately 100 RPM or more, the drum may be rotated without risk of clothes or other items being separated from the inner wall surface of the drum. If the first RPM is approximately 400 RPM or more, moisture contained in clothes or other items may be removed without causing damage to delicate clothes or other items. If the first RPM is approximately 800 RPM or more, removal of moisture up to a predetermined level may be ensured. Although several reference values with respect to the first RPM have been proposed, as described above, the first RPM may be selected within a rotating speed range of the drum that ensures sufficient removal of moisture contained in clothes or other items by those skilled in the art.

Meanwhile, in the case of the first rotation cycle, step S22, in which the drum may be rotated at the first RPM for a predetermined period of time to remove moisture contained in clothes or other items, the drum may be rotated for a predetermined period of time at a different RPM, that is, at a dehydration RPM that is greater than the first RPM. More specifically, while the drum is rotated at the first RPM for a first preset period of time during the first rotation cycle, step S22, the rotating speed of the drum may be temporarily increased, such that the drum is rotated at the dehydration RPM for a second preset period of time within the first preset period of time. In this case, the dehydration RPM may be greater than the first RPM. Also, the drum may be continuously accelerated to reach the dehydration RPM. Alternatively, the drum may be rotated stepwise to reach the dehydration RPM. In this case, the dehydration RPM may be a maximum RPM of the drum. In this way, it may be possible to apply the greatest centrifugal force to the clothes or other items at the greatest RPM available in the clothes treatment apparatus.

With this embodiment, hot air may be fed to the drum 12 before implementation of the first rotation cycle, step S22, which may be included in the dehydration operation, step S20, to remove moisture contained in clothes or other items. Since the hot air may act to reduce the surface tension of moisture contained in clothes or other items, this may facilitate removal of moisture contained in clothes or other items.

The second rotation cycle, step S24, may be performed after the first rotation cycle, step S22, ends. During the second rotation cycle, step S24, the drum may be rotated at the second RPM. The second RPM may be less than the dehydration RPM, and less than the first RPM.

As the drum is rotated at the first RPM during implementation of the first rotation cycle, step S22, clothes or other items may be unintentionally adhered to the inner wall surface of the drum after completion of the first rotation cycle, step S22. For this reason, when feeding hot air into the drum to dry clothes or other items immediately after implementation of the first rotation cycle, step S22, it may be difficult to uniformly eject hot air onto the clothes or other items, and moreover, the entangled clothes or other items may cause deterioration in the drying efficiency of clothes or other items. To solve these problems, with this embodiment, the second rotation cycle, step S24, may be right after completion of the first rotation cycle, step S22. During the second rotation cycle, step S24, a procedure of rotating the drum until the drum reaches the second RPM and stopping rotation of the drum after the drum reaches the second RPM may be repeatedly performed.

In the case of the second rotation cycle, step S24, a controller, such as controller 100 of FIG. 2, may control rotation and stoppage of the drum to ensure that clothes or other items are not adhered to the inner wall surface of the drum. That is, during the second rotation cycle, step S24, a drive, such as drive 16 of FIG. 2, may repeatedly perform rapid acceleration and braking of the drum, enabling disentangling of clothes or other items received in the drum. More specifically, during the second rotation cycle, step S24, a procedure of increasing the rotating speed of the drum to the second RPM, and thereafter stopping rotation of the drum may be repeatedly performed. That is, during the second rotation cycle, step S24, after the falling of clothes or other items, the drum may be again rotated at a high speed in a given direction, and this procedure repeated. In this case, the clothes or other items in the drum may be disentangled by shock caused upon falling thereof. More particularly, the drum may be re-rotated after a predetermined period of time has passed from stoppage of rotation. The drum may be repeatedly rotated in forward and reverse directions.

During implementation of the hot air feed operation, step S10, and the dehydration operation, step S20, the blower fan may be operated to guide hot air into the drum. In this case, the blower fan may be continuously driven without stoppage. That is, the drying heater, which heats air to be fed into the drum, may be turned on during the hot air feed operation, step S10, and may be turned off during the dehydration operation, step S20. In this case, the blower fan may be driven while the drying heater is in an off state during the dehydration operation, step S20, thereby allowing unheated air to be fed into the drum.

Since the drying heater is not driven during the dehydration operation, step S20, the blower fan may be operated to circulate hot air, which has already been generated by the drying heater and received in the drum, within the cabinet. On the other hand, the blower fan may be operated to discharge air received in the drum to the outside of a cabinet, such as cabinet 2 of FIG. 1.

In the case of a clothes treatment apparatus having a washing function according to an embodiment, the method for controlling the clothes treatment apparatus according to embodiments may further include a wash water supply operation for supplying wash water into the drum. In this case, the wash water supply operation may be performed before the hot air feed operation, step S10. That is, the clothes treatment apparatus having a washing function may perform a washing cycle (or a rinsing cycle) before the dehydration operation, step S20. In this case, the wash water supply operation may be performed during the washing cycle (or the rinsing cycle). As such, the hot air feed operation, step S10, and the dehydration operation, step S20, may be successively performed in a state in which clothes or other items are wetted via implementation of the wash water supply operation.

Meanwhile, assuming that the clothes treatment apparatus has only a drying function, the clothes or other items, which may be completely subjected to the washing cycle in the above described clothes treatment apparatus having a washing function, may be put into the clothes treatment apparatus having only a drying function. Accordingly, even in this case, the hot air feed operation, step S10, and the dehydration operation, step S20, may be performed on the wet clothes or other items in the drum, so as to achieve a reduction in surface tension of moisture contained in the clothes or other items, and consequently enhancement in dehydration efficiency using hot air.

Figure 4:
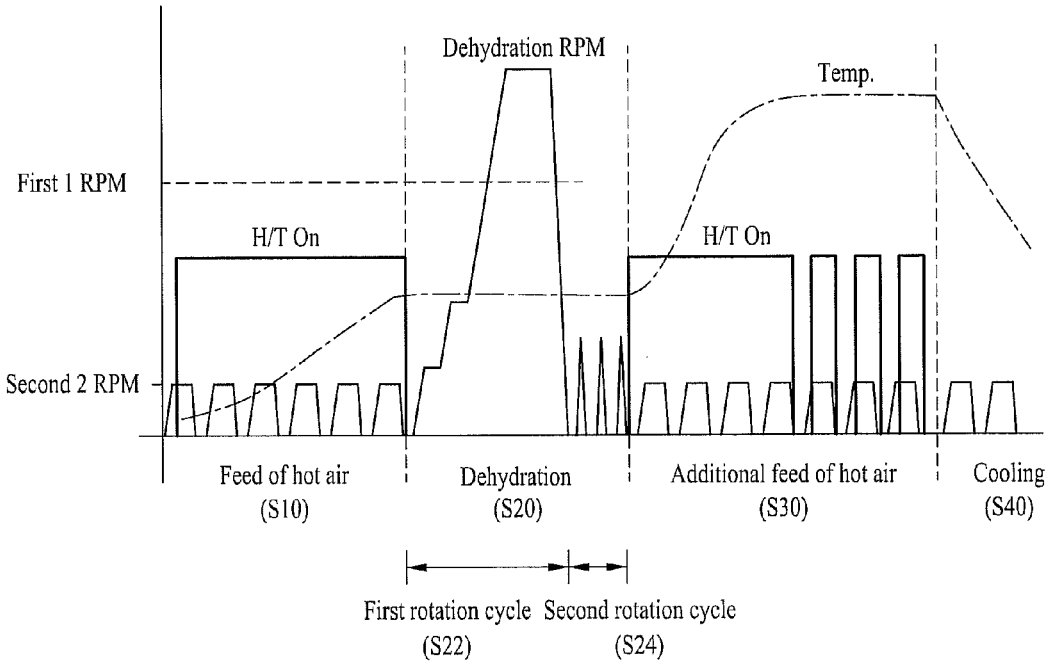
FIG. 4 is a process flow diagram of a method for controlling a clothes treatment apparatus according to another embodiment.

FIG. 4 is a process flow diagram of a method for controlling a clothes treatment apparatus according to another embodiment. The embodiment shown in FIG. 4 is similar to the embodiment shown in FIG. 3, except for including an additional hot air feed operation and a cooling operation. Thus, repetitive disclosure has been omitted.

The method of FIG. 4 may include an additional hot air feed operation, step S30, which may involve feeding hot air to clothes or other items after the dehydration operation, step S20, ends. An operation for performing an additional process may be inserted between the dehydration operation, step S20, and the additional hot air feed operation, step S30, if needed for user convenience. However, in the description of the embodiment of FIG. 4, no additional operation is performed after implementation of the dehydration operation, step S20, and before the additional hot air feed operation, step S30.

During the additional hot air feed operation, step S30, the drying heater may be driven to generate hot air and the blower fan may be driven to guide the hot air into the drum. As will be appreciated from FIG. 4, the interior temperature of the drum may be raised during the additional hot air feed operation, step S30. Unlike the hot air feed operation, step S10, the drying heater may be intermittently driven during the additional hot air feed operation, step S30.

During the additional hot air feed operation, step S30, the drum may be rotated at the third RPM for a predetermined period of time, and rotation and stoppage of the drum may be repeatedly performed. In this case, the third RPM may be the third RPM of the hot air feed operation, step S10. However, the RPM of the drum in the additional hot air feed operation, step S30, may differ from the RPM of the drum in the hot air feed operation, step S10.

After the additional hot air feed operation, step S30, ends, the cooling operation, step S40, for cooling clothes or other items may be performed. Since clothes or other items received in the drum may be exposed to a high temperature, the user may suffer from inconvenience or the risk of burn when pulling out the clothes or other items. Thus, the cooling operation, step S40, may serve to lower the temperature of clothes or other items after the additional hot air feed operation, step S30, ends.

During the cooling operation, step S40, the drying heater may not be driven. In the case of driving only the blower fan without driving the drying heater, hot air present in the drum may be discharged outward through, for example, an exhaust port formed in the cabinet. As the hot air is discharged from the drum, the temperature of clothes or other items as well as the interior temperature of the drum may be lowered.

Meanwhile, even in the case of the cooling operation, step S40, the drum may be rotated at a predetermined RPM, to ensure efficient heat exchange between the clothes or other items received in the drum and the circulating air or exhaust air, and consequently to ensure efficient cooling. In this case, the drum may be rotated at the third RPM, and may be rotated continuously or intermittently.

Figure 5:
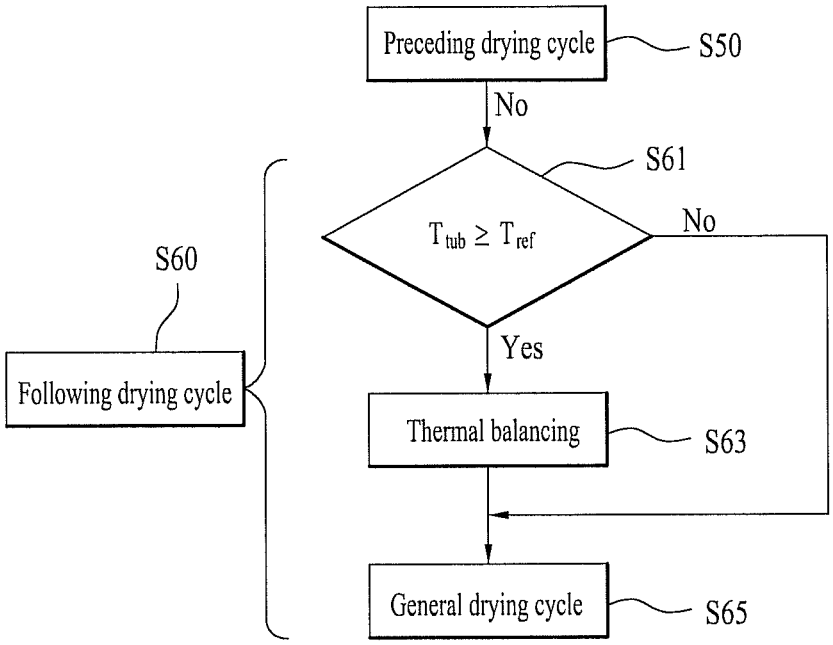
FIG. 5 is a flowchart of a method for controlling a clothes treatment apparatus according to an embodiment.

FIG. 5 is a flowchart of a method for controlling a clothes treatment apparatus according to another embodiment. The method according to this embodiment may be applied in the case of continuous drying. Herein, continuous drying may refer to successive and repeated implementation of a drying cycle using the same tub. That is, continuous drying may refer to a preceding drying cycle being performed, and in turn, a following drying cycle being performed. In other words, continuous drying may refer to clothes or other items primarily dried during the preceding drying cycle and pulled from the drum, and thereafter, new clothes or other items put into the drum and dried during the following drying cycle, step S60. Meanwhile, the interior temperature of the tub may be remarkably higher than room temperature immediately after the preceding drying cycle, step S50. Alternatively, the interior temperature of the tub may be raised if an exterior temperature of the tub is high. More specifically, the interior temperature of the tub may be raised via implementation of continuous drying.

If a general drying cycle is performed in a state in which the interior temperature of the tub is higher than a reference temperature, the interior temperature of the tub may be raised beyond a temperature that the tub reaches during the general drying cycle. This may have a negative effect on durability of thermally vulnerable components of the clothes treatment apparatus, such as a bearing, and may cause damage to clothes or other items due to excessive heat applied to the clothes or other items.

Moreover, even in terms of reduction in power consumption, again heating the tub, which has already reached a high temperature, may be undesirable because this may increase the amount of heat emitted outward. Therefore, if the interior temperature of the tub is greater than a predetermined level, thermal energy of the tub may be utilized. That is, if the interior temperature of the tub is greater than a reference temperature, utilizing heat of the tub may prevent unnecessary energy consumption.

Also, since a temperature of newly input clothes or other items may be less than the interior temperature of the tub, there may be a temperature difference between the interior of the tub and the clothes or other items. In the case of controlling the clothes treatment apparatus based on temperature, the interior temperature of the tub may be measured rather than the temperature of the clothes or other items. Therefore, there is a risk of clothes or other items being not heated to a temperature required for true drying, which may cause insufficient drying.

As such, if the interior temperature of the tub is greater than the reference temperature, it may be desirable to utilize thermal energy of the tub for the purpose of a reduction in power consumption, and to lower the interior temperature of the tub so as to avoid deterioration in durability of the clothes treatment apparatus. Also, it may be necessary to balance the interior temperature of the tub and the temperature of clothes or other items to ensure correct implementation of the drying cycle.

Although the preceding drying cycle, step S50, may be performed according to the method as described above with reference to FIGS. 1 to 4, the disclosure is not limited thereto. Alternatively, the preceding drying cycle, step S50, may be a general drying cycle, in which the hot air feed operation may be repeatedly performed, or in which the hot air feed operation and the cooling operation may be performed.

Referring to FIG. 5, the method of controlling a clothes treatment apparatus according to another embodiment may include the following drying cycle, step S60, which, in turn, may include measuring an interior temperature of the tub, performing a thermal balancing operation, step S63, for feeding unheated air into the drum by turning off the drying heater and turning on the blower fan if the interior temperature of the tub is equal to or greater than a preset reference temperature, and performing a general drying cycle, step S65, if the interior temperature of the tub is less than the reference temperature.

In this case, the preceding drying cycle, step S50, may be performed before the following drying cycle, step S60. In the preceding drying cycle, step S50, the hot air feed operation, or a series of the hot air feed operation and the cooling operation may be performed to dry clothes or other items received in the drum. After the clothes or other items are completely dried via implementation of the preceding drying cycle, step S50, the user may pull the dried clothes or other items from the drum and put new clothes or other items to be dried into the drum. Then, the user may input a signal for beginning the following drying cycle, step S60. In this case, the user may input the signal for beginning the following drying cycle, step S60 by maneuvering a control panel, such as control panel 24 of FIG. 1, provided on the clothes treatment apparatus.

The following drying cycle, step S60, may be performed in response to a signal for beginning the following drying cycle, step S60, from a user.

First, the interior temperature of the tub may be measured. If the interior temperature of the tub is greater than a reference temperature $T_{ref}$, step S61, a thermal balancing operation, step S63, may be performed to feed unheated air into the drum. If the interior temperature of the tub is less than the reference temperature, the general drying cycle may be performed.

In this case, the thermal balancing operation, step S63, may be performed at an initial stage of the following drying cycle, step S60. Also, the thermal balancing operation, step S63, may be performed simultaneously with a beginning of the following drying cycle, step S60.

Further, the general drying cycle, step S65, may include the hot air feed operation, step S10, for feeding hot air into the drum to dry clothes or other items. In this case, the cooling operation, step S20, for cooling clothes or other items may be performed after the hot air feed operation, step S10. The hot air feed operation, step S10, and the cooling operation, step S20, may be identical to the above description, and thus, a detailed description thereof has been omitted.

After the thermal balancing operation, step S63, ends, the general drying cycle, step S65, may be performed. The end of the thermal balancing operation, step S63, will be described hereinafter.

The thermal balancing operation, step S63, will be described with reference to FIG. 6. First, the interior temperature of the tub may be measured, step S100. The tub may refer to a space in which laundry (i.e., clothes or other items) may be received and subjected to the drying cycle upon receiving hot air. To measure the interior temperature of the tub, a direct measurement method using a value sensed by a temperature sensor, such as temperature sensor 60 of FIG. 1, may be used.

Alternatively, instead of using the measured value from the temperature sensor, a method for calculating the interior temperature of the tub may be used. In this method, a time passed from completion of the preceding drying cycle, step S50, of the clothes treatment apparatus, may be measured. The interior temperature of the tub may be calculated based on the measured time and based on a decreasing rate of temperature per unit time after the preceding drying cycle, step S50. This calculation method may be performed under an assumption of continuous implementation of the drying cycle, i.e. continuous drying.

After measurement of the interior of the tub, step S100, is completed, it may be judged whether the interior temperature of the tub is greater or less than a preset reference temperature, step S200. The reference temperature may refer to a temperature that ensures stable implementation of the drying cycle without deterioration in durability of the clothes treatment apparatus, even if the clothes treatment apparatus performs the general drying cycle. For example, the reference temperature may be set within a range of about 40° C. to 60° C.

If the interior temperature of the tub is equal to or greater than the reference temperature, only the blower fan may be driven for a temperature compensation time, step S300. Here, the temperature compensation time may be a time taken until laundry achieves a predetermined level of thermal balance with respect to a reference temperature, and may be changed based on the reference temperature, the performance of the blower fan, and a size of the tub, for example.

Figure 8:
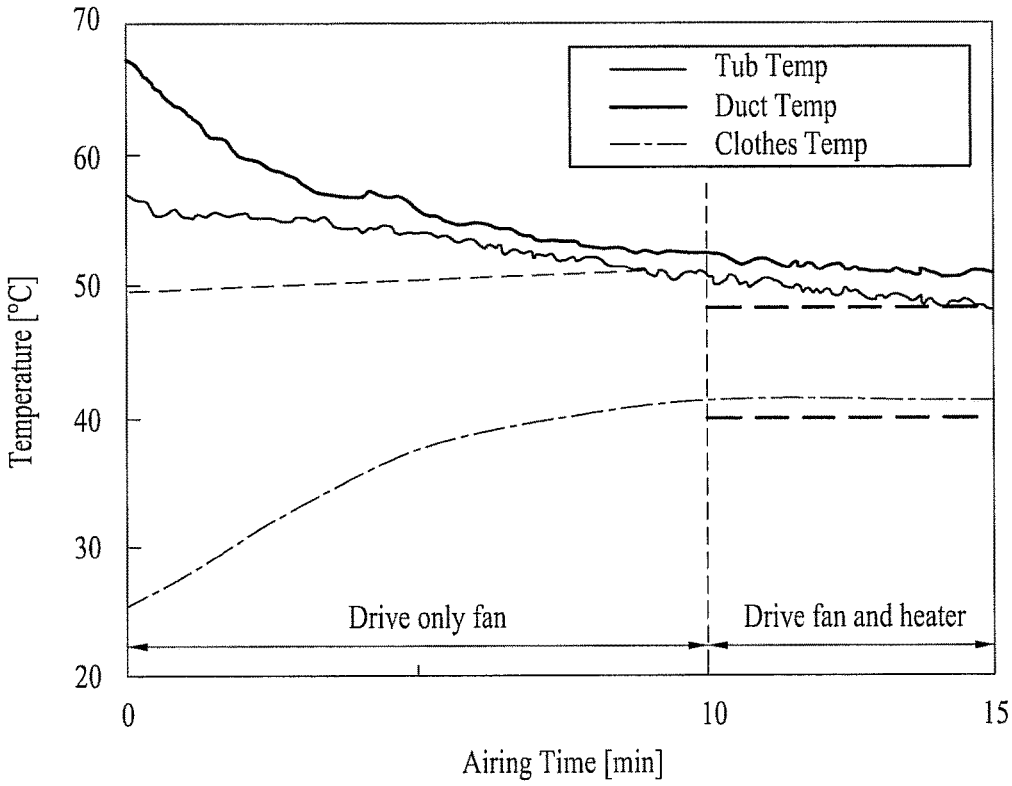
FIG. 8 is a graph showing variation of temperature during a drying cycle.

FIG. 8 is a graph showing variation of temperature during a drying cycle in a method for controlling a drying cycle of a clothes treatment apparatus according to an embodiment. FIG. 8 shows variation in temperature of the tub, in temperature of a duct as an air circulating passage of the tub, and in temperature of laundry (i.e., clothes or other items) during implementation of the drying cycle according to embodiments. The tub and the duct may be connected spaces and exhibit similar variation in temperature.

Assuming that the reference temperature is approximately 50° C., as shown in FIG. 8, the interior temperature of the tub may be greater than the reference temperature, and thus, only the blower fan may be driven. When only the blower fan is driven, laundry may be dried as the temperature of laundry is raised by heated air circulating through the tub and the duct. After about 10 minutes have passed on the basis of the graph of FIG. 8, the laundry and the tub may exhibit substantially no variation in temperature.

More specifically, a difference between the interior temperature of the tub and the temperature of the laundry may converge into a predetermined range, realizing thermal balance between the interior of the tub and the laundry. As such, a time taken until the difference between the interior temperature of the tub and the temperature of the laundry received in the drum converges into the predetermined range (about 10 minutes in the embodiment shown in FIG. 4) may be set to the temperature compensation time, and only the blower fan may be driven during the temperature compensation time. That is, the thermal balancing operation, step S63, may be performed for the preset temperature compensation time, and implementation of the thermal balancing operation, step S63, may be completed after the preset temperature compensation time has passed.

Alternatively, the temperature compensation time may be set to a short time, for example, approximately 30 seconds, 1 minute, or 2 minutes. In this case, an operation of measuring the interior temperature of the tub may be essential, and this will be described in more detail hereinafter.

It may be judged whether a driving time of the blower fan exceeds the temperature compensation time, step S350. If only the blower fan is driven for the temperature compensation time, and the driving time of the blower fan exceeds the temperature compensation time, it may be judged that the interior of the tub and the laundry are thermally balanced, and thus, the general drying cycle, i.e. simultaneous driving of the blower fan and the drying heater may be performed, step S400.

If the interior temperature of the tub is less than the reference temperature, the drying heater and the blower fan may be simultaneously driven, step S400. Since a possibility of the above described problems due to overheating of the tub may be reduced if the interior temperature of the tub is less than the reference temperature, the general drying cycle may be performed.

Figure 7:
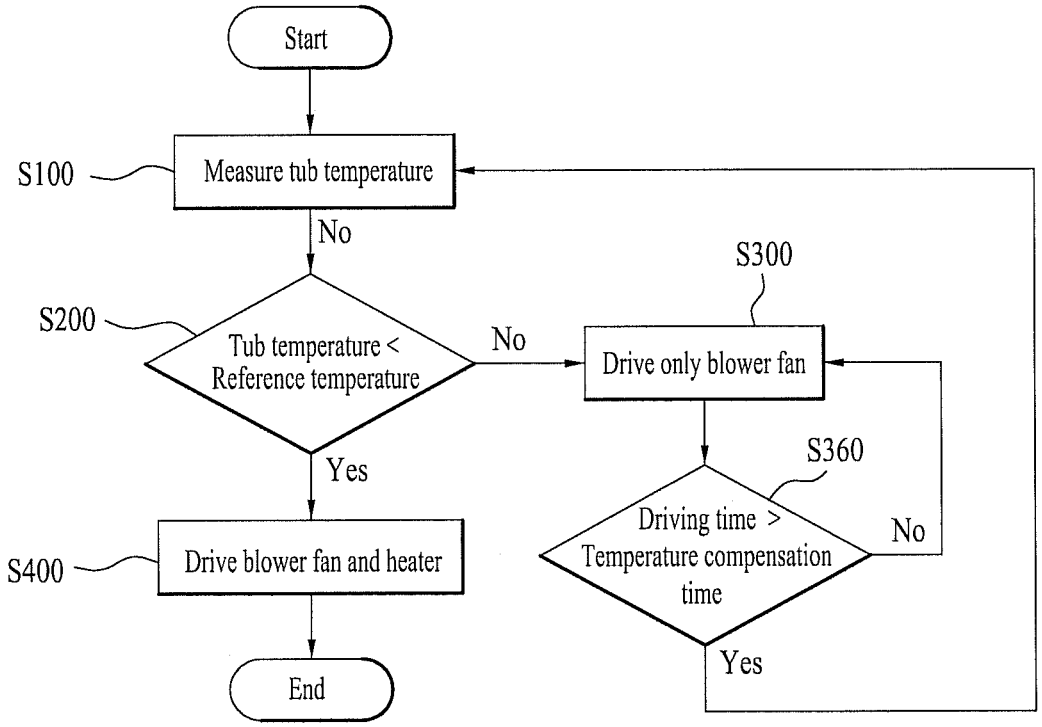

Next, referring to FIG. 7, another embodiment of a method for controlling a clothes treatment apparatus according to embodiment will be described. Similar to the above described embodiment, the interior temperature of the tub may be measured, step S100. If the interior temperature of the tub is greater than or equal to the reference temperature, only the blower fan may be driven, step S300. If the interior temperature of the tub is less than the reference temperature, the blower fan and the drying heater may be simultaneously driven.

However, if the driving time of the blower fan exceeds the temperature compensation time, step S360, the interior temperature of the tub may again be measured, step S100. Then, it may be judged whether the interior temperature of the tub becomes less than the reference temperature, step S200. That is, if the interior temperature of the tub becomes less than the reference temperature after the preset temperature compensation time has passed, the general drying cycle may be performed.

In the case where the temperature compensation time is set to a short time, such as approximately 30 seconds, and 1 minute as described above, judging whether the interior temperature of the tub becomes less than the reference temperature may enable more accurate control. In the case in which a time taken until a difference between the interior temperature of the drum and the temperature of laundry received in the drum converges into a predetermined range is set to the temperature compensation time, both the embodiment of FIG. 6 and the embodiment of FIG. 8 may be applied.

Figure 6:
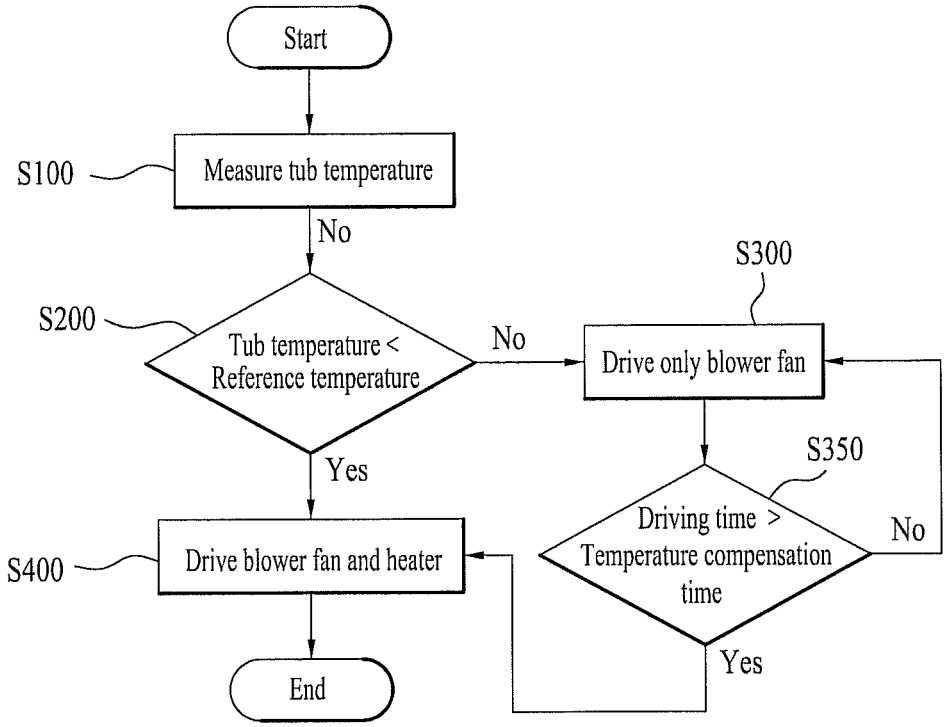
FIGS. 6 and 7 are flowcharts showing a thermal balancing operation according to embodiments.

In the embodiment of FIG. 6, implementation of the thermal balancing operation, step S63, ends as the preset temperature compensation time has passed. In the embodiment of FIG. 7, the end of the thermal balancing operation, step S63, may be judged by comparing the interior temperature of the tub with the reference temperature after the preset temperature compensation time has passed. In addition, the thermal balancing operation, step S63, may end if the interior temperature of the tub is less than the reference temperature. That is, the interior temperature of the tub may be periodically or intermittently measured after implementation of the following drying cycle, step S60, such that the thermal balancing operation, step S63, may be performed until the interior temperature of the tub is less than the reference temperature.

As is apparent from the above description, according to embodiments, through intermittent rotation of a drum, it may be possible to prevent clothes or other items from being adhered to an inner wall surface of the drum and to realize uniform dispersion of the clothes, which may result in enhanced drying performance.

Further, according to embodiments disclosed herein, it may be unnecessary to continuously feed hot air for removal of moisture contained in clothes or other items. This may eliminate driving of a heater, achieving a reduction in power consumption.

Furthermore, through a method for controlling a drying cycle of a clothes treatment apparatus, it may be possible to prevent overheating of the clothes treatment apparatus, which may prevent damage to components of a drying mechanism and damage to laundry due to high temperature. In addition, as a result of utilizing residual heat within the clothes treatment apparatus for the drying cycle, enhanced energy efficiency of the clothes treatment apparatus may be accomplished.

Embodiments disclosed herein are directed to a clothes treatment apparatus and a method for controlling a clothes treatment apparatus that substantially obviate one or more problems due to limitations and disadvantages of the related art.

Embodiments disclosed herein provide a clothes treatment apparatus and a method for controlling a clothes treatment apparatus capable of efficiently removing moisture contained in wet clothes. Further, embodiments disclosed herein provide a clothes treatment apparatus and a method for controlling a clothes treatment apparatus, in which driving of a drying heater and a blower fan may be controlled based on an internal state of the clothes treatment apparatus, which may result in enhanced energy efficiency and prevent damage to components of the clothes treatment apparatus due to high temperatures.

Embodiments disclosed herein provide a method for controlling a clothes treatment apparatus that may include feeding hot air to clothes or other items received in a drum, and dehydrating the clothes or other items by performing a first rotation cycle for rotating the drum at a first RPM for a predetermined time, wherein the first RPM is an RPM that allows centrifugal force applied to the clothes or other items during rotation of the drum to exceed gravity. The first RPM may be approximately 100 RPM, or approximately 400 RPM or more.

The first rotation cycle may include accelerating the drum continuously or stepwise until the drum reaches the first RPM. However, outside of the first rotation cycle a continuous or stepwise accelerating and/or decelerating may be performed. In this case, the feeding of hot air may include turning on a drying heater that heats air to be fed into the drum, and the dehydration may include turning off the drying heater. The dehydration may include driving a blower fan in an off state of the drying heater, so as to feed the air into the drum.

The method may further include supplying wash water into the drum, and the supply of wash water may be performed before the feeding of hot air. The dehydration may further include a second rotation cycle. The second rotation cycle may be adapted to intermittently rotate the drum at a second RPM. The second RPM may be less than the first RPM. However, it could also be similar or higher than the first RPM.

The second rotation cycle may be shorter than the first rotation cycle. Further, the second rotation cycle may include repeatedly performing a procedure of rotating the drum until the drum reaches the second RPM and stopping rotation of the drum after the drum reaches the second RPM.

The feeding of hot air may include rotating the drum for a predetermined time. The feeding of hot air may include repeating rotation and stoppage of the drum.

The method may further include additionally feeding heated hot air to the clothes or other items received in the drum after completion of the dehydration. The method may further include cooling the clothes or other items received in the drum after completion of the additional feeding of hot air.

Embodiments disclosed herein provide a method for controlling a clothes treatment apparatus that may include measuring an interior temperature of a tub, and performing thermal balancing by turning off a drying heater and turning on a blower fan to feed unheated air into a drum if an interior temperature of the tub is greater than or equal to a preset reference temperature, and performing a general drying cycle if the interior temperature of the tub is less than the preset reference temperature. The general drying cycle may be performed after completion of the thermal balancing. The thermal balancing may be performed for a preset temperature compensation time. The thermal balancing may end when the interior temperature of the tub is less than the reference temperature.

The general drying cycle may be a following drying cycle performed after a preceding drying cycle, and the following drying cycle may be performed upon receiving a corresponding drying cycle beginning signal from a user. The temperature compensation time may be calculated based on time passed from completion of the preceding drying cycle and based on a decreasing rate of temperature per unit time after the preceding drying cycle. The reference temperature may be set within a range of approximately 40° C. to 55° C.

Embodiments disclosed herein further provide a method for controlling a clothes treatment apparatus that may include receiving a signal that begins a following drying cycle from a user after completion of a preceding drying cycle, measuring an interior temperature of a tub at an initial stage of the following drying cycle, and feeding unheated air into a drum for a predetermined time if the interior temperature of the tub is equal to or greater than a preset reference temperature.

Embodiments disclosed herein further provide a method for controlling a clothes treatment apparatus that may include measuring an interior temperature of a tub, comparing the interior temperature of the tub with a predetermined reference temperature, and driving only a blower fan for a temperature compensation time if the interior temperature of the tub is equal to or greater than the reference temperature, and driving a drying heater and the blower fan simultaneously if the interior temperature of the tub is less than the reference temperature. The measurement of the temperature may utilize a value sensed by a temperature sensor within the tub. The measurement of the temperature may include measuring time passed after completion of a preceding drying cycle of the laundry treatment apparatus and calculating the temperature based on the measured time and based on a decreasing rate of temperature per unit time after the preceding drying cycle.

The temperature compensation time may be set to a time taken until a difference between an interior temperature of a drum and laundry received in the drum converges to a predetermined range. The reference temperature may be set within a range of approximately 40° C. to 55° C.

After completion of the driving of only the blower, the methods may further include measuring the interior temperature of the tub, comparing the interior temperature of the tub with the predetermined reference temperature, and driving only the blower fan for the temperature compensation time if the interior temperature of the tub is equal to or greater than the reference temperature and driving the drying heater and the blower fan simultaneously if the interior temperature of the tub is less than the reference temperature may be performed. After completion of the driving of only the blower, the simultaneous driving of the drying heater and the blower fan may be performed.

Embodiments disclosed herein also provide a clothes treating apparatus that may include a drum in which laundry may be received, a drying heater configured to apply heat to air, a blower fan configured to feed the air into the tub, and a controller adapted to control the blower fan and/or the drying heater based on an interior temperature of the drum.

Additionally, embodiments disclosed herein provide a clothes treating apparatus that may include a tub and/or a drum in which laundry may be received, a drying heater configured to apply heat to air, a blower fan configured to feed the air into the tub or drum, and a controller that drives only the blower fan for a temperature compensation time if an interior temperature of the tub and/or drum is equal to or greater than a predetermined reference temperature and simultaneously driving the drying heater and the blower fan if the interior temperature of the tub and/or drum is less than the reference temperature.

The laundry treating apparatus may further include a temperature sensor configured to sense an interior temperature of the tub and transmit data of the interior temperature of the tub to the controller. The controller may calculate the interior temperature of the tub based on a time passed after completion of a preceding drying cycle of the clothes treatment apparatus and based on a decreasing rate of temperature per unit time after the preceding drying cycle. The temperature compensation time may be set to a time taken until a difference between an interior temperature of a drum and laundry received in the drum converges to a predetermined range. The reference temperature may be set within a range of approximately 40° C. to 55° C.

After driving only the blower for the temperature compensation time, the controller may again measure the interior temperature of the tub, and may drive only the blower fan for the temperature compensation time if the interior temperature of the tub is equal to or greater than the reference temperature and may simultaneously drive the drying heater and the blower fan if the interior temperature of the tub is less than the reference temperature. The controller may simultaneously drive the heater and the fan after only the fan is driven for the temperature compensation time.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a clothes treatment apparatus including a preceding drying cycle and a following drying cycle, which comes after the receding drying cycle, the method comprising:

performing the preceding drying cycle having a dehydration cycle for removing moisture contained in the clothes, wherein the dehydration cycle includes:

feeding hot air to the clothes received in a drum; and dehydrating the clothes by performing a first rotation cycle including rotating the drum at a first RPM for a first predetermined period of time, wherein the first RPM is an RPM that allows a centrifugal force applied to the clothes during rotation of the drum to exceed gravity; and performing the following drying cycle which dries new clothes and includes:

measuring an interior temperature of a tub;

performing thermal balancing by turning off a drying heater and turning on a blower fan to feed unheated air into a drum it the interior temperature of the tub is greater than or equal to a preset reference temperature; and performing a general drying cycle if the interior temperature of the tub is less than the preset reference temperature.

2. The method according to claim 1, wherein the first RPM is higher than approximately 100 RPM.

3. The method according to claim 1, wherein the first RPM is higher than approximately 400 RPM.

4. The method according to claim 1, wherein the first rotation cycle further includes accelerating the drum continuously or stepwise at least until the drum reaches the first RPM.

5. The method according to claim 1, wherein the feeding of hot air includes turning on the drying heater to heat air to be fed into the drum.

6. The method according to claim 1, wherein the dehydrating includes turning off the drying heater.

7. The method according to claim 1, further including;

driving the blower fan.

8. The method according to claim 7, wherein during an off state of the drying heater, the blower fan is driven, to feed unheated air into the drum; during an on state of the drying heater, the blower fan is driven, to feed heated air into the drum; or both.

9. The method according to claim 1, wherein the dehydrating further includes a second rotation cycle.

10. The method according to claim 9, wherein during the second rotation cycle, the drum is intermittently rotated at a second RPM.

11. The method according to claim 9, wherein the second RPM is less than the first RPM.

12. The method according to claim 9, wherein the second rotation cycle includes repeatedly rotating the drum until the drum reaches at least the second RPM and stopping rotation of the drum after the drum reaches second RPM.

13. The method according to claim 1, further including:

during the first rotation cycle, temporarily rotating the drum at a dehydration RPM, which is greater than the first RPM.

14. The method according to claim 1, further including at least one of:

supplying wash water into the drum before the feeding of the hot air to the clothes;

the feeding of the hot air includes rotating the drum for a predetermined period of time;

the feeding of the hot air includes repeatedly rotating and stopping the drum;

receiving a signal input by a user for beginning the following drying cycle after completion of the preceding drying cycle;

additionally feeding hot air to the drum after the dehydrating; or cooling the drum after completion of the additional feeding of hot air.

* * * * *